United States Patent [19]

Carmichael

[11] Patent Number: 4,829,970

[45] Date of Patent: May 16, 1989

[54] IGNITION SYSTEM

[75] Inventor: Thomas F. Carmichael, Drayton Plains, Mich.

[73] Assignee: Syncro Corporation, Troy, Mich.

[21] Appl. No.: 107,628

[22] Filed: Oct. 9, 1987

Related U.S. Application Data

[60] Division of Ser. No. 888,557, Mar. 20, 1978, and a continuation of Ser. No. 660,122, Feb. 23, 1976, abandoned, which is a continuation-in-part of Ser. No. 460,271, Apr. 12, 1974, Pat. No. 4,056,088.

[51] Int. Cl.[4] ..... F02P 3/06

[52] U.S. Cl. ..... 123/595; 123/599

[58] Field of Search ..... 123/149 R, 149 A, 149 C, 123/149 D, 599, 600, 601, 602, 595

[56] References Cited

U.S. PATENT DOCUMENTS

| | | | |
|---|---|---|---|
| Re. 21,679 | 12/1940 | Jacobi | 123/149 D |
| Re. 31,230 | 5/1983 | Swift et al. | 123/601 X |
| 3,484,677 | 12/1969 | Piteo | 123/149 A X |
| 3,598,098 | 8/1971 | Sohner et al. | 123/601 |
| 3,722,488 | 3/1973 | Swift et al. | 123/149 R X |
| 3,941,111 | 3/1976 | Carmichael et al. | 123/600 |
| 4,170,977 | 10/1979 | Carmichael et al. | 123/595 X |

*Primary Examiner*—Tony M. Argenbright

*Attorney, Agent, or Firm*—Harness, Dickey & Pierce

[57] ABSTRACT

A means for readily changing the ignition system of an existing internal combustion engine to a solid state capacitive discharge ignition system which comprises an auxiliary coil, a primarty ignition coil and a secondary ignition coil wound on a single leg of a stator. The stator is designed with one or more additional legs which complete a conductive path for the time varying flux, and adapt the stator for mounting on the existing structure of the engine. In addition, two legs of the stator which define a flux path may each be divided into two segments at their outer extremity, one of each pair being slightly longer than the other so as to create two different size air gaps for each leg. A washer-like element may be used in cooperation with the above structure to change the position of the rotor relative to the crankshaft so as to alter the timing of the ignition system.

25 Claims, 5 Drawing Sheets

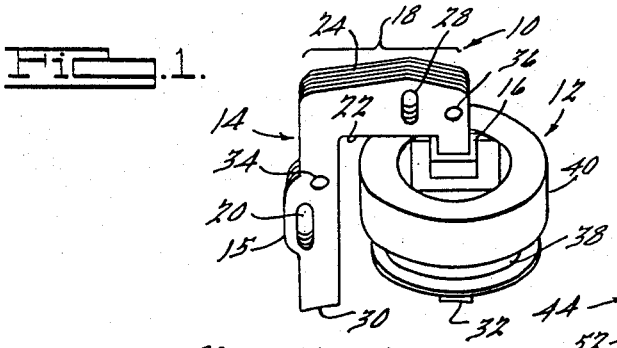
FIG. 1.
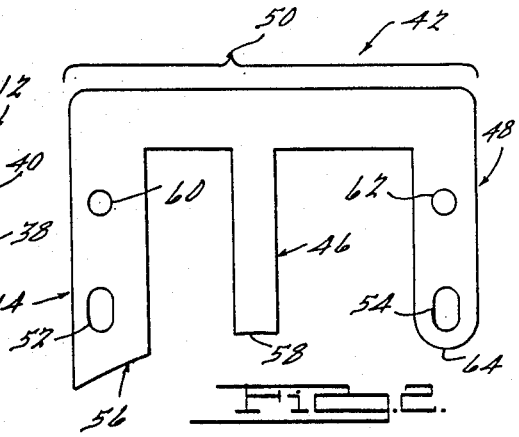
FIG. 2.
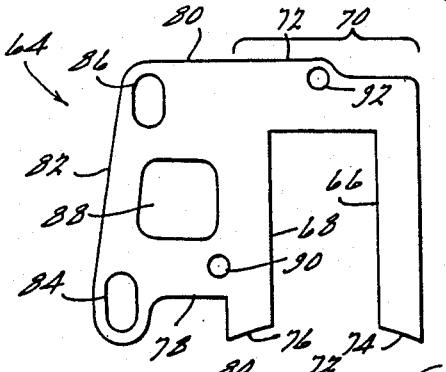
FIG. 3.
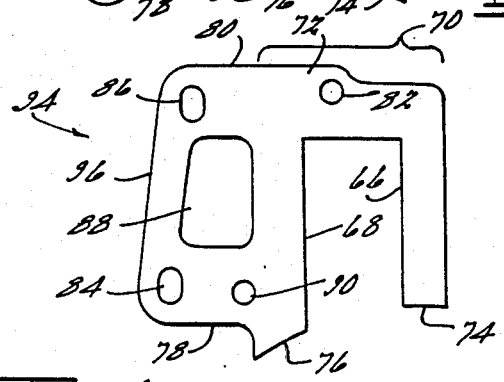
FIG. 4.
FIG. 6.
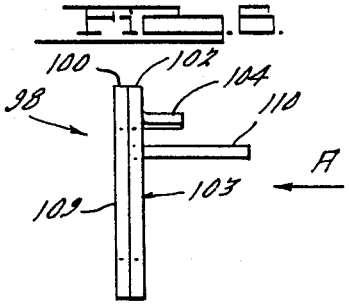
FIG. 5.
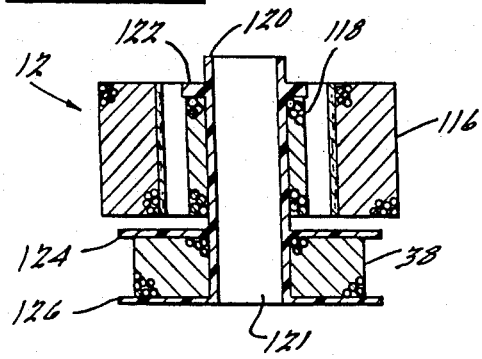
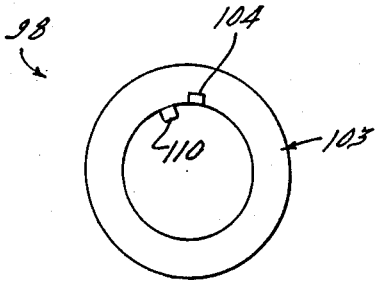
FIG. 7.

IGNITION SYSTEM

CROSS REFERENCE TO RELATED APPLICATION

This application is a division of application Ser. No. 888,557, filed Mar. 20, 1978, which application is a continuation of U.S. patent application Ser. No. 660,122 filed Feb. 23, 1976, now abandoned and which in turn is a continuation-in-part of Ser. No. 460,271 filed Apr. 12, 1974, now issued as U.S. Pat. No. 4,056,088 on Nov. 1, 1977, said application Ser. No. 460,271 having been copending with application Ser. No. 660,122.

BACKGROUND AND SUMMARY OF THE INVENTION

This invention relates generally to ignition systems for internal combustion engines and in particular to means by which an existing combustion engine having a conventional ignition system may be provided with a capacitor discharge ignition system with minimal time and effort. This ignition system is generally of the type disclosed in my copending application for "Ignition System", Ser. No. 460,271, filed Apr. 12, 1974, and the copending application of Richard J. Maier and myself for "Ignition System", Ser. No. 395,908, filed Sept. 10, 1973, now issued as U.S. Pat. No. 3,941,111, both of which are assigned to the assignee of this application. The disclosure of each of those applications is incorporated hereby by reference thereto.

Previously, the complex nature of capacitive discharge ignition systems made them prohibitively expensive for application to smaller internal combustion engines presently utilizing simple magneto ignition systems. With the development of the improved system disclosed in the above referenced copending applications, the number of components, package size, complexity and cost have been reduced sufficiently to allow the incorporation of such systems into these smaller sized engines such as are used in lawnmowers, chain saws, outboard motors, and the like. The ignition systems of the aforementioned applications are generally applicable for incorporation during original equipment manufacture of the associated engines. The present invention provides an inexpensive ignition replacement package whereby existing conventional magneto ignition systems may be easily converted to this improved capacitive discharge system by the owner of the engine subsequent to its initial purchase. The substantial achievement of this invention can be appreciated when the nature of existing engines and their associated ignition systems is considered. In order for a conversion kit to be commercially practical, it must be adaptable for use with a variety of engine configurations. Conventional magneto systems may have a rotor rotating either clockwise or counterclockwise. Also, the leading magnetic pole may be either north or south seeking. Further, the ignition timing of the existing ignition system may not be appropriate due to the differing response characteristics. Additionally, varying existing space limitations must be considered since a conversion would not be commercially practical if significant engine structure modifications were required. The present invention as described herein bridges wide variations in engine and existing ignition systems so as to provide a conversion kit in which a minimum of component structure variations will accommodate a large variety of engine and ignition system configurations without structural modifications.

Additional advantages and features of the present invention will become apparent from the following detailed description taken in conjunction with the attached drawings and appended claims.

BRIEF DESCRIPTION OF THE DRAWINGS

FIG. 1 is a perspective view of a coil wound upon a stator having two legs with mounting provisions contained thereon all in accordance with the present invention;

FIG. 2 is a second embodiment of the present invention showing a stator structure with a third leg for accommodating an existing mounting structure;

FIG. 3 is a third embodiment of the present invention showing a stator structure employing yet another mounting arrangement;

FIG. 4 is a fourth embodiment of the present invention similar to that of FIG. 3 but employing a different mounting structure;

FIG. 5 is a sectional side view of the coil assembly utilized in conjunction with the core structures of the present invention;

FIG. 6 is an edge view of a keyway shifter for use in altering the existing timing sequence;

FIG. 7 is another view of the keyway shifter of FIG. 6 as viewed from the direction of arrow A of FIG. 6;

DESCRIPTION OF THE PREFERRED EMBODIMENT

Figure 8:
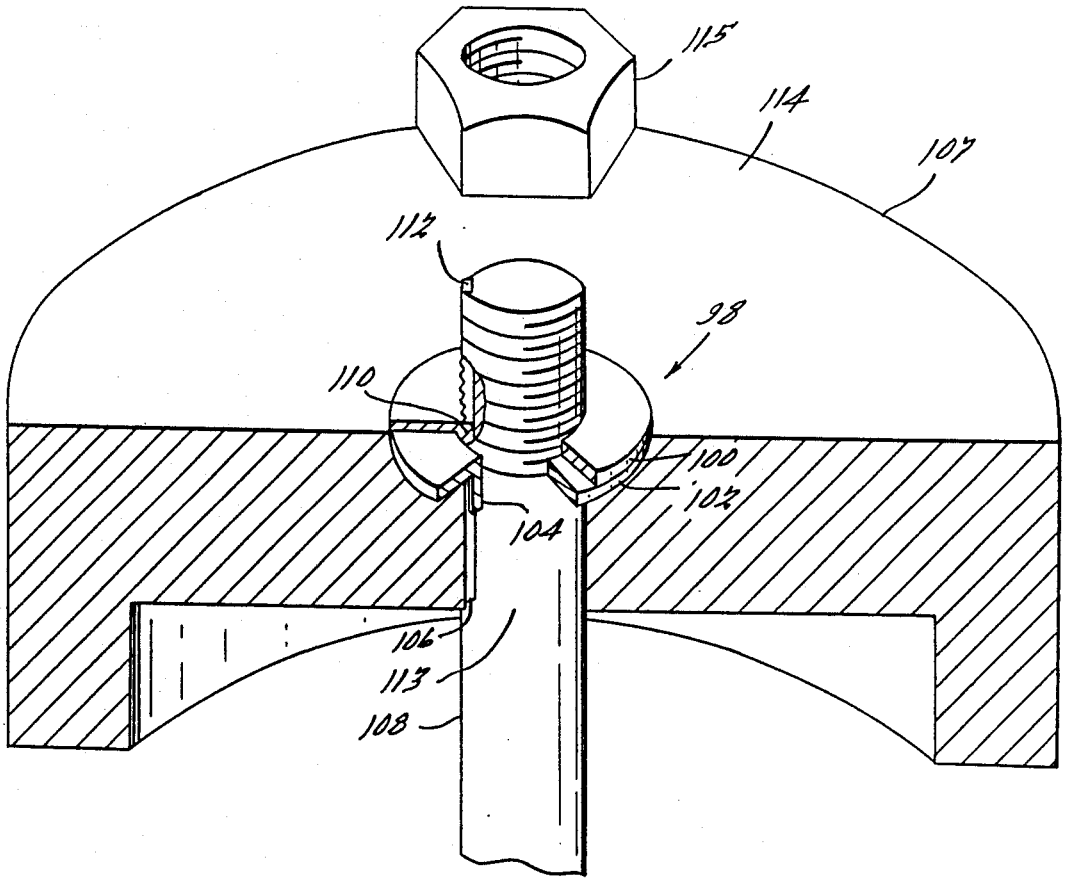
FIG. 8 is a sectional perspective view of a portion of a crankshaft of an internal combustion engine having a rotor mounted thereon and showing a keyway shifter installed in operative relation thereto.

Referring now to FIG. 1, a stator 10 is shown containing a coil assembly 12 on one leg thereof. Stator 10 has a generally rectangular cross section and is generally "U" shaped having a pair of spaced apart substantially parallel legs 14 and 16 and an interconnecting portion 18 extending between and connecting one end of each of legs 14 and 16. Leg 14 has a protrusion 15 extending outward there-from and disposed approximately midway along its length. Leg 14 also has an elongated aperture 20 adjacent protrusion 15 and extending along the longitudinal axis thereof. Interconnecting portion 18 has one side 22 which is perpendicular to the longitudinal axis of legs 14 and 16 and a second side 24 which is bowed outward from side 22 so as to have a maximum width portion at a point slightly offset toward leg 16 from its midpoint. Also, interconnecting portion 18 similarly has an elongated aperture 28 disposed adjacent the maximum width portion and extending between sides 22 and 24 and parallel to aperture 20. Apertures 20 and 28 are located on stator 10 so as to coincide with existing mounting pads provided on an internal combustion engine and are substantially equally elongated, thus providing means by which the air gap between the stator and a rotating magnetic field may be adjusted, as is described in greater detail below. Legs 14 and 16 are substantially equal in length and have respective convex end surfaces 30 and 32 thereon.

Conventionally, the cores of magneto ignition systems are constructed of cold rolled steel. Cold rolled steel cores are used since the cold rolled steel is an excellent collector of flux emanating from the permanent magnets of the rotor. Although the core material of the ignition systems disclosed herein can be cold rolled steel, it has been discovered that electrical steel, i.e., steel containing a silicone alloy as is used in transformer core constructions, provides a substantial increase in the output voltage of the ignition system. For example, output voltage increases of 40% have been obtained using electrical steel. It is believed that this substantial increase in output voltage is due to the fact that cold rolled steel is not a desirable core material for the ignition coil so that the voltage rise upon discharging of the capacitor into the primary winding of the ignition coil is hampered. The electrical steel is a more effective core for the ignition coil than cold rolled steel, and yet has a good capability of collecting the flux emanating from the permanent magnets of the rotor. The usual core materials for ignition coils are ferrite materials. These materials would not be satisfactory as a core material for the ignition system since they would not be good collectors of the flux emanating from the permanent magnets of the rotor. Accordingly, stator 10 is preferably constructed of multiple laminations of electrical steel secured by two rivets 34 and 36 as shown in FIG. 1 or other like fastening devices.

Leg 16 of stator 10 has coil assembly 12 surrounding its longitudinal midportion. Coil assembly 12 comprises auxiliary coil 38 located adjacent convex surface 32 and ignition coils 40 disposed immediately behind auxiliary coil 38. Coil assembly 12 will be described in greater detail below.

Stator 10 is particularly suited for use with the Roper 2.5 chain saw engine ignition system. In such an application, convex surfaces 30 and 32 have a curvature radius of between 1.760 and 1.764 inches and are symmetrical about a longitudinal axis extending approximately equidistant between legs 14 and 16. Further, in such an application, the stator structure is constructed of 13 laminations secured together by two rivets and having a total thickness of from 0.305 to 0.322 inches.

Stator 10 is thus designed to be mounted on existing mounting pads of an engine with convex surfaces 30 and 32 of legs 14 and 16, respectively, immediate adjacent the outer peripheral surface of a rotor of an existing conventional internal combustion engine. The rotor has a pair of magnets disposed on its outer peripheral surface which create a timing varying magnetic flux in stator 10, as the magnets rotate past stator 10. Thus, legs 14 and 16 and interconnecting portion 18 define a conductive path for the flux created by this rotating magnetic field. As the flux is necessarily time varying with respect to stator 10, a voltage will thereby be generated in coil assembly 12. The nature and effect of this voltage will be described in greater detail below.

FIG. 2 is a second embodiment of the invention showing a stator structure 42 having three legs 44, 46 and 48, spaced apart and extending substantially parallel from an interconnecting portion 50. Leg 44 has a longitudinally elongated aperture 52 located near its end opposite that of interconnecting portion 50. Similarly, leg 48 has a longitudinally elongated aperture 54 located near its end opposite that of interconnecting portion 50. Legs 44 and 46 each have respective convex end surfaces 56 and 58, which have a radius of curvature similar to that of a rotor for which stator 42 is designed to be used. Also, apertures 52 and 54 are located on respective legs 44 and 48, so as to coincide with existing mounting pads on an existing engine which is desired to be converted to a capacitive discharge ignition system. Stator 42 is constructed similarly to that of stator 10, having a plurality of identical shaped laminations of electrical steel or other suitable magnetic material, secured by rivets 60 and 62 disposed on legs 44 and 48. Leg 48 is disposed at one end of interconnecting member 50 and preferably has a rounded end portion 64. Leg 48 is spaced apart from leg 46 a slightly greater distance than the distance between leg 46 and leg 44. Stator 42 is adapted to be mounted on existing mounting pads of an existing conventional internal combustion engine with convex surfaces 56 and 58 immediately adjacent a rotor similarly to that of stator 10. Thus, legs 44 and 46 and that portion of interconnecting portion 50 extending therebetween, define a conductive path for the magnetic flux induced by the engine rotor. A coil assembly similar to that shown at 12 in FIG. 1 is mounted on leg 46 of stator 42 for generating the ignition voltages. As leg 48 is spaced apart from the rotating magnetic field, it is effectively removed from the magnetic circuit and serves to provide means to mount the stator 42 to the existing engine mounting pads while allowing the ignition timing of the engine to be modified by the angular displacement of the coil structure.

Stator 42 is particularly suited for use in the retrofit of certain Briggs and Stratton engines. In such an application, the radius of curvature for convex surfaces 56 and 58 will be of the order of 2.885 to 2.890 inches and the stator will have a thickness on the order of 0.305 to 0.322 inches.

Referring now to FIG. 3, another embodiment of a stator 64 is shown. Stator 64 has substantially parallel and spaced apart legs 66 and 68 extending from interconnecting portion 70. Interconnecting portion 70 has a slightly wider portion 72 extending from leg 68 to a point approximately midway between legs 66 and 68. Legs 66 and 68 also have convex end surfaces 74 and 76 similar to those previously described. Leg 68 has a member 78 extending outward from stator 64, perpendicular to the longitudinal axis of leg 68 and disposed near convex end surface 76. Leg 68 also has a member 80 extending outward and substantially parallel to member 78 from the point of merger between leg 68 and interconnecting portion 70. Member 80 is slightly shorter than member 78. A third member 82 extends between the ends of members 78 and 80 and protrudes a short distance beyond member 78. Member 82 has longitudinally elongated apertures 84 and 86 adjacent opposite ends thereof. Members 78, 80, and 82 form a support arm and, with leg 64, enclose a generally rectangular shaped aperture 88 therebetween. Stator 64 is similarly constructed as those of FIGS. 1 and 2 having multiple laminations secured by rivets 90 and 94 or the like. A coil assembly similar to that at 12 of FIG. 1 is disposed on leg 66. In this embodiment, legs 66 and 68 and interconnecting portion 70 define a magnetic flux conducting path. As members 78, 80 and 82 do not extend from the same leg on which the coil assembly is disposed, any flux conducted by these members must also flow through leg 66, thereby contributing to the induction of voltage in the coil assembly. Thus, while members 78, 80 and 82 form an alternative flux path, it will not affect the voltage induced in coil 12.

Stator 64, described above, is particularly suited for adapting Beaird-Poulan chain saw engine ignition systems to the capacitive discharge system of the present invention. In such an application, convex surfaces 74 and 76 have a curvature radius on the order of 1.229 to 2.239 inches and are symmetrical about an axis extending longitudinally approximately midway between legs 74 and 76.

FIG. 4 shows another embodiment of a stator 94 which is similar to that of FIG. 3 and thus like portions are indicated by like numerals. The only exception is that member 96 does not extend beyond member 78 but rather merges smoothly into member 78.

The embodiment of FIG. 4 is particularly suited for conversion of Roper 3.7 chain saw engine ignition systems to the capacitive discharge system of the present invention. In such an application, convex surfaces 74 and 76 will have a radius of curvature on the order of 2.010 to 2.016 inches with leg 66 being slightly shorter than leg 68.

The coil assembly 12 shown generally in position on a stator structure 10 in FIG. 1 is illustrated in isolation and sectionalized in FIG. 5. The coils are arranged as best seen in FIG. 5 with a secondary coil 116 wound over the primary ignition coil 118 and the auxiliary coil 38 located forward of the ignition coils. Primary ignition coil 118 and secondary ignition coil 116 comprise the ignition coils indicated at 40 in FIG. 1. It is important to the operational sequence of the capacitive discharge system that neither the primary nor secondary ignition coil windings be concentric with the auxiliary coil windings. Further, experimentation has shown that optimum results are obtained when a minimum ⅜" spacing between the ignition coils and the auxiliary coil is maintained and the auxiliary coil is located forward of the ignition coils. In order to facilitate assembly, the coils are wound on a form 120 having a rectangular or square opening 121 running longitudinally therethrough and having radially outwardly extending flanges 122, 124 and 126 serving to aid in securing the coils in position. Form 120 may be fabricated from any suitable material such as plactic for example.

Experimentation and research has shown that, because of variation of direction of rotor rotation and polarity of the leading magnetic pole, two different winding configurations are required.

In the first of these coil configurations, the auxiliary, primary, and secondary ignition coil windings are wound counterclockwise and all have their finished ends connected to ground. This coil configuration is designed to be used in all applications in which the leading magnetic pole of the rotor is south seeking, such as the Roper and Beaird-Poulan engine previously referred to. Further, optimum results were achieved when the coil assembly was mounted on the first or leading pole of the stator structure.

In the second configuration, both the auxiliary and primary ignition coils are wound counterclockwise and have the starting end connected to ground whereas the secondary ignition coil is wound clockwise and has its finished end connected to ground. This coil configuration is designed to be used in all applications in which the leading magnetic pole of the rotor is north seeking, such as the Briggs and Stratton engines previously referred to. Further, optimum results were achieved when the coil assembly was mounted on the second or trailing pole of the stator assembly.

Experimentation has further shown that the following number of coil turns and wire gauges have given optimum performances:

Auxiliary Coil:

Two cycle engine: 2,000 turns number 39 wire.

Four cycle engine: 4,000 turns number 40 wire.

Primary Ignition Coil:

96 turns of number 22 wire for both 2 and 4 cycle engines.

Secondary Ignition Coil:

9,630 turns of number 44 wire for both 2 and 4 cycle engines.

The completed coil assembly will preferably have an outer covering such as an epoxy compound or the like to seal it against moisture or other potentially damaging elements. Also, the coil will have provisions externally of this covering for the connection of the high voltage lead, a ground connection, and primary and auxiliary coil connection to the ignition module described below. Alternatively, the coil may be constructed with the ignition module integral thereto assuming space limitations permit. This will further simplify the conversion in that the only electrical connection required will be the high voltage lead.

In converting some engine ignition systems to the capacitive discharge ignition system, greater timing adjustment may be required than can be accomplished through the design of the stator structure alone. Alternatively, space limitations of the engine structure may preclude the use of a modified stator structure embodying ignition timing correction. Generally, in conventional magneto ignition systems, the rotor is retained in position relative to its shaft rotation by a woodruff keyway. Substitution of a replacement rotor with a relocated keyway would greatly increase the cost of any capacitive discharge ignition conversion system thus making a conversion kit prohibitively expensive. Accordingly, a keyway shifter, as shown at 98 in FIG. 6, is provided. The keyway shifter includes two similarly shaped disc-like portions 100 and 102, both generally round in shape. Section 102 has an aperture 103 therein of a diameter equal to or slightly larger than the diameter of a crankshaft to which the keyway shifter is to be fitted so as to allow it to be slipped over the shaft. A protrusion 104 extends axially outward from the edge of aperture 103 and is of cross sectional size approximating that of a keyway slot 106 on a rotor 107 as shown in Figure 8. Section 100 also has an aperture 109 therein of a diameter approximately the same as shaft 108 of an engine and aperture 103. A protrusion 110 extends axially outward from the edge of the aperture and has a transverse cross sectional size approximately that of a keyway slot 112 on shaft 108. The two sections 100 and 102 are welded together with the angle between the protrustions 110 and 104 being adjusted to accomplish a predetermined timing change of the rotor. This angular displacement is best seen by reference to FIG. 7 showing a keyway shifter of FIG. 6 as viewed along a line indicated generally by arrow A of FIG. 6.

The installation and operative relationship of keyway shifter 98 is best seen with reference to FIG. 8 in which a rotor 107 is illustrated partially broken away but otherwise in operative relationship to a crankshaft 108 of an internal combustion engine. Crankshaft 108 is disposed in a cylindrical bore 113 extending through rotor 107. Rotor 107 has a keyway slot 106 disposed on the peripheral surface of bore 113 and crankshaft 108 has a similar keyway slot 112 disposed on its peripheral surface. As originally manufactured with the conventional ignition system keyway slots 112 and 106 are aligned and retain a woodruff key to prevent relative rotation. In order to install the keyway shifter of the present invention, the woodruff key is first removed thus allowing rotor 107 to be rotated relative to shaft 108. Protrusion 110 of keyway shifter 98 is first inserted in keyway slot 112, rotor 107 is then rotated with respect to shaft 108 to bring keyway 106 into alignment with protrustion 104 of keyway shifter 98 thus allowing section 102 of keyway shifter 98 to engage the upper surface 114 of rotor 107. A jam nut 115 is then tightened down over keyway shifter 98 and rotor 107 thus securing them to shaft 108. It is possible in certain applications that the keyway slot on the rotor may not extend completely through to the top surface thereof or the keyway slot on the crankshaft may not extend to the upper end of the shaft. This situation usually occurs when the keyway slots have been formed by a milling machine. In either case, in order to install the keyway shifter of the present invention, it will be necessary to extend the keyway slot so as to provide openings for the keyway shifter to seat in. This may easily be done by filing of the rotor or crankshaft.

Figure 9:
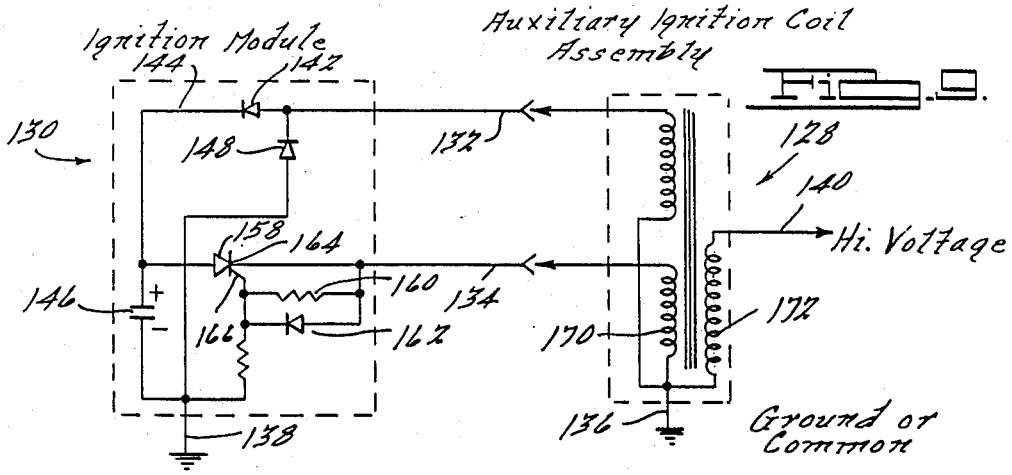
FIG. 9 is a schematic diagram of the capacitive ignition system in accordance with the present invention.
Figure 10:
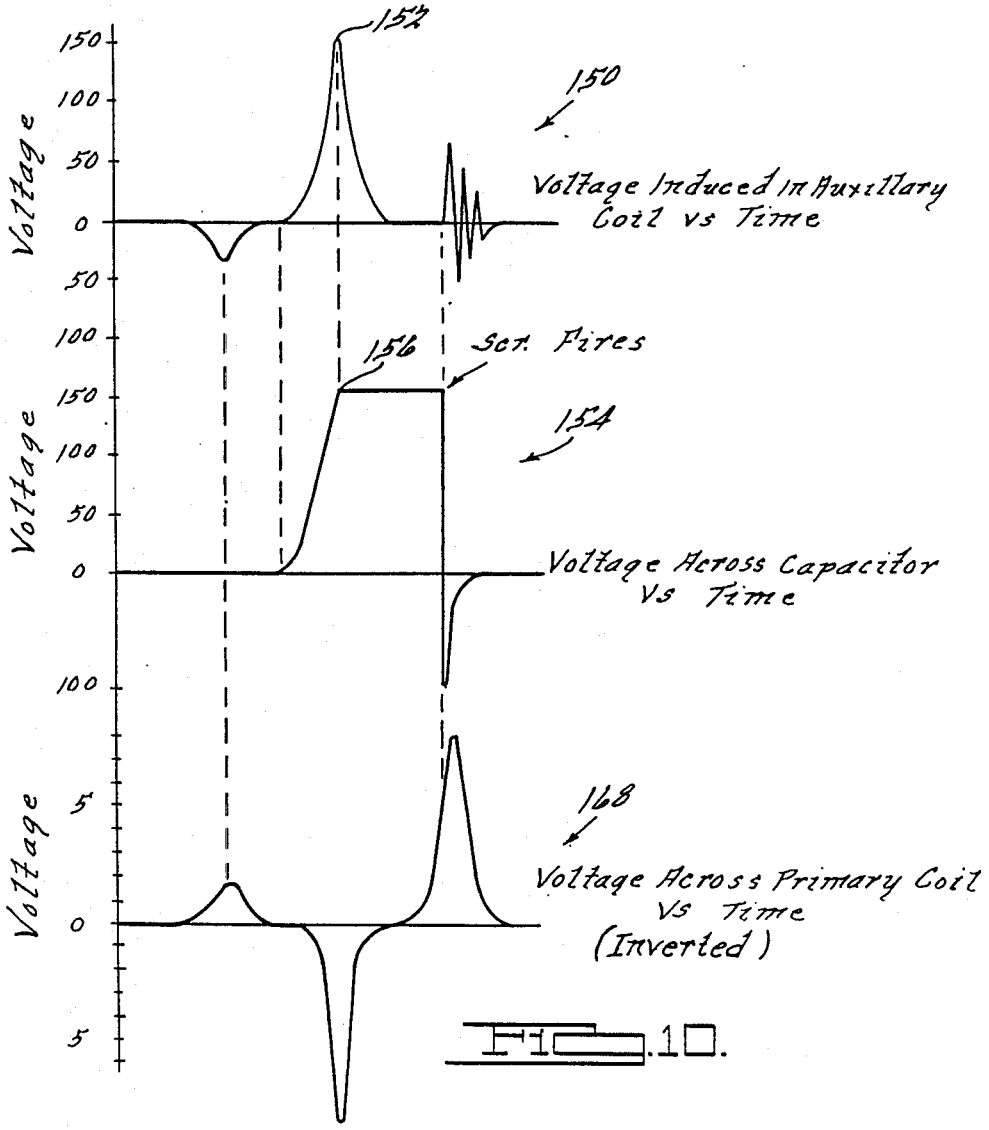
FIG. 10 is a graphical plot of voltage vs. time showing the operating waveforms for a capacitive discharge ignition system of the present invention.

Referring now to FIGS. 9 and 10, the operation of the present invention will be described in detail. A coil assembly is shown schematically at 128 of FIG. 9. In operative position, the coil and appropriate stator structure described above would be securely mounted to the engine adjacent the rotor carrying the magnetic field generating means. An ignition module, as shown schematically at 130 of FIG. 9 is mounted on the engine in any convenient location and is electrically coupled to the coil assembly by conductors 132 and 134. Both the coil assembly and ignition module have means 136 and 138, respectively, for creating an electrical connection to ground which, in this case, may be the engine itself. Additionally, coil assembly 128 has a high voltage conductor 140 for conducting the ignition voltage to the spark plug.

As the rotating magnetic field, carried by the rotor, passes in close proximity to the stator core, it induces therein a time varying magnetic flux. As this flux increases in magnitude, it induces a voltage in the auxiliary coil which causes a current to flow from the coil assembly along conductor 132 through diode 142 and conductor 144 to capacitor 146 creating a positive charge thereon. Diode 148 is connected between conductor 132 and ground 138 and serves to dampen negative spikes induced in the auxiliary coil. The voltage induced in the auxiliary coil, as this time varying magnetic field increases in intensity, is plotted against time in graph 150 of FIG. 10 with maximum intensity being achieved at point 152. Graph 154 shows the voltage vs. time plot of the charging of capacitor 146 in response to the induced voltage on the auxiliary coil. As shown graphically, capacitor 146 achieves a maximum charge at point 156 which corresponds in time to the maximum rate of change of flux intensity passing through the stator coil. As diode 142 only conducts in one direction, the charge on capacitor 146 will be maintained.

A switch means 158, such as a silicone controlled rectifier (SCR), is provided between capacitor 146 and primary conductor 134 connected to the primary coil winding. A resistor 160 and a diode 162 are connected in parallel between the cathode 164 and gate 166 of SCR 158. Diode 162 serves to protect SCR 158 from positive transients induced in the primary coil winding during the charging of capacitor 146.

As the rotating magnetic field begins to move out of alignment with the stator, the magnetic flux following therethrough begins to drop. This then causes a negative voltage to be induced in the primary coil, thus causing a current to flow through conductor 134. This will then cause gate 166 of SCR 158 to be positively biased with respect to cathode 164, thus causing SCR 158 to become conductive. This is shown pictorially on graph 168 of FIG. 10, which plots voltage vs. time as measured across the primary winding. When SCR 158 becomes conductive, capacitor 146 will discharge through SCR 158 and through primary coil 170. As the primary and secondary ignition coils are magnetically coupled, the discharge through primary coil 170 cooperatively with the time varying magnetic flux induces the ignition spark generating voltage in secondary coil 172.

In order to maintain maximum operating efficiency of the engine, it is important to insure capacitor 146 will repetitively fire at precisely the same time relative to the angular position of the crankshaft with as little variation as possible over the entire broad speed range of the engine. It has been found through experimentation that the ignition module circuit of FIG. 9 in cooperation with the degree of magnetic coupling of the ignition and auxiliary coils and their polarity relationships plus the lack of frequency sensitivity in the SCR gate network produce greater timing stability than found in conventional ignition systems.

In certain applications, it is desirable to have the spark timing retarded during starting of the engine but, when the engine is at operating speed, it becomes necessary to advance the ignition timing in order to obtain maximum engine efficiency. Accordingly, it is desirable to provide means which would automatically accomplish this without increasing the costs of the conversion contemplated herein.

Figure 11:
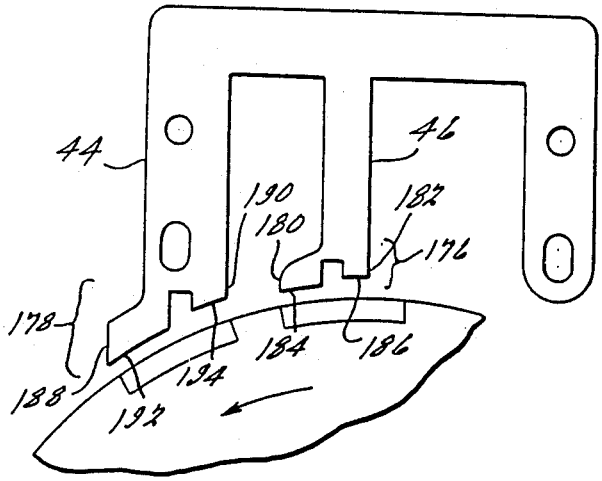
FIG. 11 is yet another embodiment of the present invention similar to that of FIG. 2 but having split leg sections.

FIG. 11 shows a stator structure 174 similar to that shown in FIG. 2 but incorporating a further modification which automatically advances the ignition timing as engine speed increases. Stator 174 is identical to stator 42 with the exception of lower leg portions 176 and 178 respectively. Leg portion 176 is divided into two spaced apart segments 180 and 182. Segment 180 extends laterally and longitudinally from the main portion of leg 46 and is slightly longer than segment 182 so as to provide a smaller air gap between the stator and rotor when installed on an engine. Both segments have convex end surfaces 184 and 186 as previously described for stator 42 of FIG. 2. Similarly, leg portion 178 is divided into two segments 188 and 190. Segment 188 extends laterally and longitudinally from the main portion of leg 44 in the same direction as segment 180 and is also slightly longer than segment 190. Both segments 188 and 190 have convex end surfaces 192 and 194 similar to those previously described. There is thus provided a slow speed flux path comprising segment 188, leg 44, interconnecting portion 50, leg 46, and segment 180, and a high speed flux path comprising segment 190, leg 44, interconnecting portion 50, leg 46 and segment 182.

At low speed operation, the trailing segments 180 and 188 provide a significantly greater operating flux for inducing the ignition voltage in the coil due to the relatively smaller air gap relative to that created by segments 182 and 190. As these sections are shifted slightly in the direction of rotor rotation relative to the main leg of the stator, the ignition timing during high speed operation is advanced relative to the ignition timing during low speed operation. As the operational speed increases, the magnetic flux provided by the leading pair of stator leg segments 182 and 190 will induce an increasingly greater voltage in the coil due to the increased rate of change of the magnetic field. This ignition voltage will necessarily be advanced relative to that induced from the flux provided by the trailing segments 180 and 188 due to the relative position of the sections. Thus, at a sufficiently high operating speed, the time varying magnetic flux provided by the leading pair of stator leg segments 182 and 190 will induce a voltage in the ignition coil sufficiently large to cause the associated capacitive discharge ignition circuitry, as described above and in the two previously referenced applications, to operate. There is thereby created means which will automatically cause the ignition timing to advance in response to increased engine speed. The positioning of the leg sections relative to each other and relative to the angle of rotation of the rotor will control the degree of timing advance or retardation.

Figure 12:
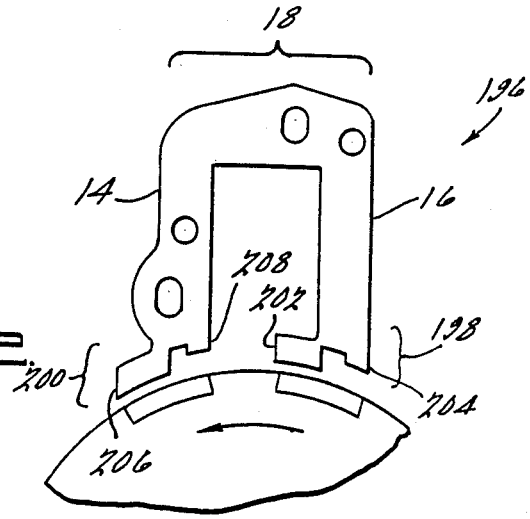
FIG. 12 is another embodiment of the present invention similar to that of FIG. 1 but also having split leg sections thereon.

FIG. 12 shows a stator structure 196 similar to that of FIG. 1 but having a further modification similar to that previously described for stator 174 of FIG. 11 incorporated thereon. Stator 196 has lower leg portions 198 and 200, each of which is divided into two segments 202, 204, 206 and 208, respectively. As previously described with reference to FIG. 11, segment 202 is slightly longer than segment 204 and segment 206 is slightly longer than segment 208 and all segments have convex end surfaces thereon. The operation of this modification is identical to that described with reference to stator 174 of FIG. 11.

Figure 13:
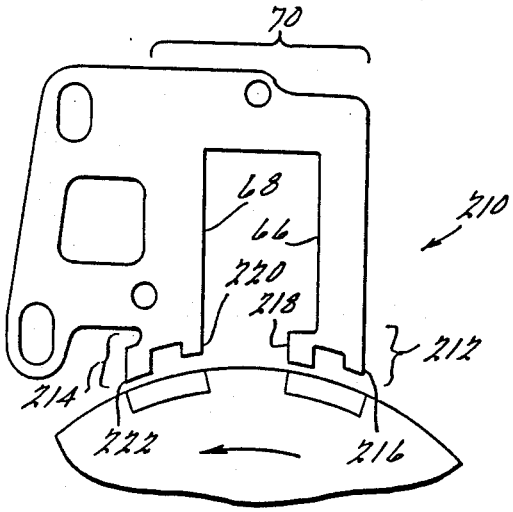
FIG. 13 is yet another embodiment of the present invention similar to that of FIG. 3 but having split leg sections incorporated thereon.

FIG. 13 in like manner shows a stator structure 210 similar to that of FIG. 3 but incorporating thereon the modification similar to that previously described for stators 174 and 196 of FIGS. 11 and 12, respectively. Stator 210 has lower leg portions 212 and 214, each of which is divided into two segments 216, 218, 220 and 222, respectively, all of which have convex end surfaces. Segment 216 is slightly shorter than segment 218 and segment 220 is slightly shorter than segment 222. The operation of this modification is identical to that previously described with reference to stator 174 of FIG. 11, a low speed flux path being defined by segment 218, leg 66, interconnecting portion 70, leg 68, and segment 222 and a high speed flux path being defined by segment 216, leg 66, interconnecting portion 70, leg 68, and segment 220. It should also be noted that this modification may be incorporated into the design of stator 94 of FIG. 4 in like manner as described with reference to stator 210.

Figure 14:
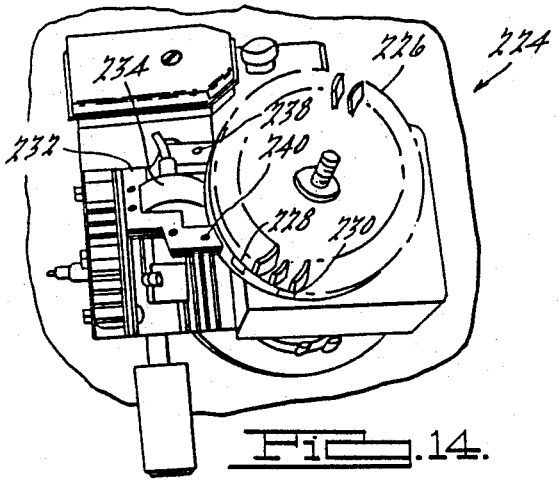
FIGS. 14 through 16 are of a typical existing lawnmower engine with the sheet metal cowling removed and showing, in sequence, a conventional ignition system installed thereon, the engine with the conventional ignition system core and coil assembly removed and the engine with a core and coil assembly of the present invention installed thereon.
Figure 15:
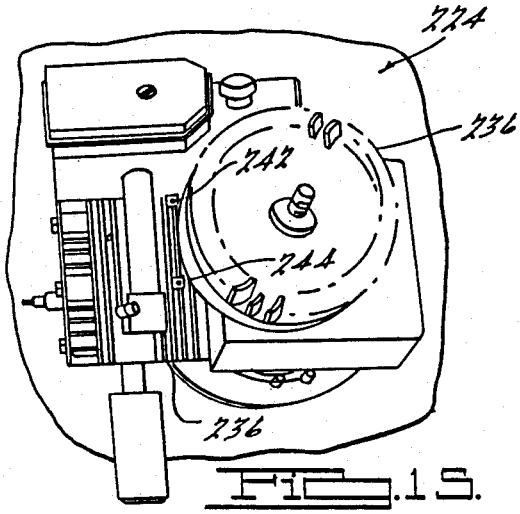
Figure 16:
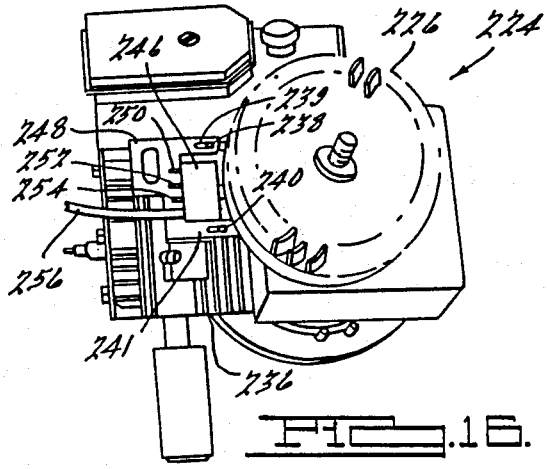

Reference is now made to FIGS. 14 through 16 in which is illustrated the sequence of operations by which an owner of an existing machine having an internal combustion engine with a conventional ignition system may avail himself of the advantages of the capacitive discharge ignition system of the present invention. In FIG. 14, there is illustrated an internal combustion engine 224 which was manufactured with a conventional ignition system. The ignition system comprises a rotor 226 having a north magnetic pole 228 and a south magnetic pole 230 spaced a short distance apart and disposed on the peripheral surface of rotor 226. The original stator 232 and coil assembly 234 is mounted on engine housing 236 immediately adjacent rotor 226 through the agency of bolts 238 and 240.

In order to convert this ignition system to that of the present invention, the existing stator 232 and coil assembly 234 is removed. As shown in FIG. 15, there is then exposed two mounting pads 242 and 244, which cooperate with bolts 238 and 240 to secure the stator and coil assembly.

A stator 248 having a coil assembly 246 mounted thereon, both in accordance with the present invention, is then secured to the mounting pads 242 and 244 through the agency of bolts 238 and 240 passing through elongated apertures 239 and 241. These elongated apertures allow stator 246 to then be positioned to afford the predetermined air gab between it and rotor 226, and bolts 238 and 240 are then tightened thus securing stator 248 in position. The ignition module previously described may be mounted in any convenient location on the machine and is electrically connected to coil assembly 246 by means of conductors 250, 252 and 254. Alternatively, the stator and coil assembly may be fabricated with the ignition module being integral thereto thus further simplifying the conversion process through the elimination of the electrical connections. High voltage conductor 256 is connected to the spark plug thus completing the installation of the ignition system of the present invention. It should be noted that the ignition timing has been adjusted by means of the construction of the new stator 248, as may be readily seen in a comparison of FIGS. 14 and 16.

Figure 17:
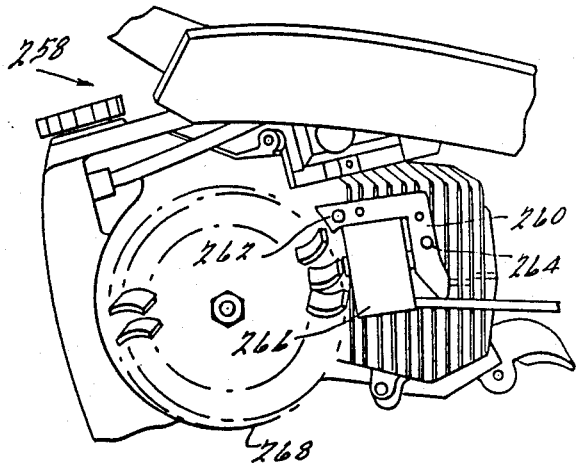
FIGS. 17 through 19 are of a typical existing chain saw engine with the sheet metal cowling removed and also showing, in sequence, the existing engine ignition system, the removal thereof, and a core and coil of the present invention installed thereon.
Figure 18:
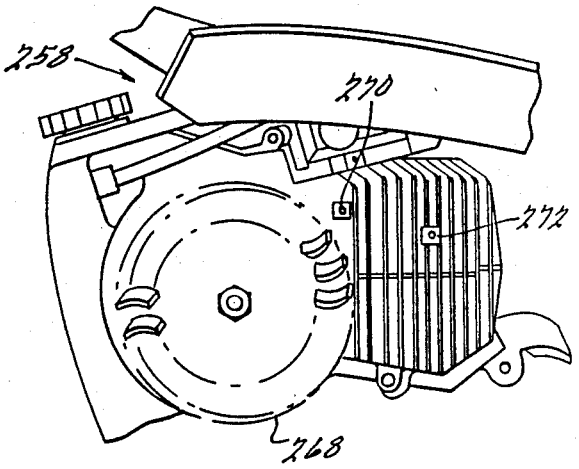
Figure 19:
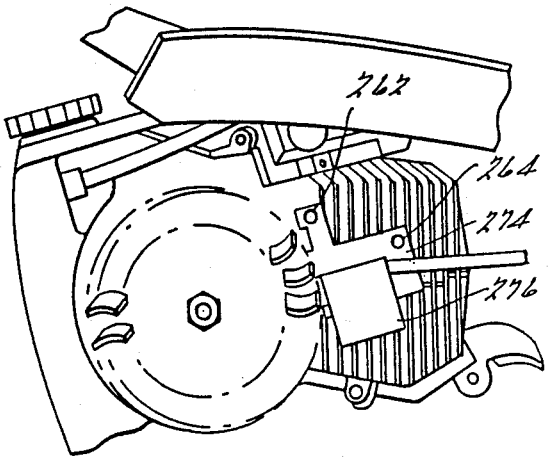

A similar conversion of an internal combustion engine of a chain saw is illustrated in FIGS. 17 through 19. FIG. 17 shows the engine 258 having a conventional ignition system comprising a stator 260 secured to engine 258 by volts 262 and 264, a coil assembly 266 mounted on stator 260, and a rotor 268. Rotor 268 has a north magnetic pole and a south magnetic pole spaced slightly apart and disposed on its outer periphery for generating the time varying magnetic flux in stator 260.

In installing the stator and coil assembly of the present invention, the existing stator 260 and coil assembly 266 are removed from engine 258 by removal of bolts 262 and 264. Thus there is exposed mounting pads 270 and 272 disposed on engine 258 as best seen in FIG. 18. The new stator 274 and coil assembly 276 of the present invention are then mounted on engine mounting pads 270 and 272 through the agency of bolts 262 and 264. Stator 274 is then positioned to afford the proper air gap between it and rotor 268 and bolts 262 and 264 are tightened, thus securing stator 274 in operative position. The ignition module previously described is then mounted in any convenient location and electrically connected to coil assembly 276 or alternatively may be integral with the stator and coil assembly as previously described. It will be noted by a comparison of FIGS. 17 and 19 that the ignition timing has been shifted approximately 18° through the use of the stator structure of the present invention, thus eliminating the need for any structural modification of the engine itself.

There is thus disclosed herein means by which any individual having a very few basic tools may easily convert the existing ignition system of his lawnmower or the like to the capacitive discharge ignition system of the present invention. As is apparent from the above description, there is provided means by which the difference in ignition timing of the capacitive discharge ignition system relative to the conventional ignition system may be compensated for so as to maintain the ignition timing of the engine. The absence of any necessity to perform delicate machining operations or the need for any complex engine modifications makes it possible to completely eliminate the need for any knowledge whatsoever of machinery operations or engine ignition system theory by the owner. Further, as the replacement of parts is minimized, the individual may achieve the advantages inherent in a capacitive discharge ignition system at a relatively small investment of money and time.

It is to be understood that the foregoing description is that of preferred embodiments of the invention. Various changes and modifications may be made without departing from the spirit and scope of the invention as defined by the appended claims.

What is claimed is:

1. For an internal combustion engine having a rotor with magnetic field means for providing a rotating magnetic field and a conventional ignition system including a first stator with at least a first stator leg cooperative with said rotating magnetic field for providing high voltage ignition pulses for said engine, said engine further having existing mounting means thereon for securing said first stator of said conventional ignition system to said engine with said first stator leg in a first predetermined position relative to the rotor and hence to said rotating magnetic field to provide first ignition timing for said engine for providing the desired ignition timing for the engine, said first ignition timing determined by said first predetermined position, a substitute capacitive discharge ignition system comprising:

a second stator, an ignition coil mounted on said second stator and adapted to provide high voltage ignition pulses for said engine;

capacitive discharge circuit means including a capacitor adapted to be discharged into said ignition coil for providing high energy ignition pulses; and said second stator having at least one leg adapted to cooperate with said rotating magnetic field to cause discharge of said capacitor into said ignition coil and having selected mounting means adapted to cooperate with said existing mounting means of said engine for securing said second stator with said one leg in a second predetermined position relative to said rotating magnetic field, said second predetermined position being displaced relative to said first predetermined position in accordance with the difference of said first ignition timing of said conventional ignition system and a second ignition timing of said capacitive discharge ignition system, said second ignition timing being determined by said second predetermined position relative to the rotor and said rotating magnetic field whereby said desired ignition timing of said engine is substantially maintained.

2. A substitute capacitive discharge ignition system as set forth in claim 1 wherein said ignition coil comprises a primary ignition coil winding and a secondary ignition coil winding disposed over said primary winding.

3. A substitute capacitive discharge ignition system as set forth in claim 2 wherein said capacitive discharge circuit means discharges into said primary ignition coil, said primary ignition coil inducing said high energy ignition pulses in said secondary coil.

4. A substitute capacitive discharge ignition system as set forth in claim 1 further comprising an auxiliary coil, said auxiliary coil being adapted to cooperate with said rotating magnetic field to charge said capacitor.

5. A substitute capacitive discharge ignition system as set forth in claim 1 wherein said capacitive discharge circuit means is further adapted to cooperate with said ignition coil to charge said capacitor.

6. A substitute capacitive discharge ignition system as set forth in claim 1 wherein said one leg of said second stator is further adapted to cooperate with said rotating magnetic field to cause said ignition coil to charge said capacitor.

7. For an internal combustion engine having a rotor with magnetic field means for providing a rotating magnetic field and a conventional ignition system including a first stator with at least one stator leg cooperative with said rotating magnetic field for providing high voltage ignition pulses for said engine, said engine further having existing mounting means thereon for securing said first stator of said conventional ignition system to said engine with said one stator leg in a first predetermined position relative to the rotor and hence to said rotating magnetic field to provide first ignition timing for said engine for providing the desired ignition timing for the engine, said first ignition timing determined by said first predetermined position, a substitute capacitive discharge ignition system comprising:

a second stator, an ignition coil mounted on said second stator and adapted to provide high voltage ignition pulses for said engine;

capacitive discharge circuit means including a capacitor adapted to be discharged into said ignition coil for providing high energy ignition pulses;

said second stator having a first leg on which is disposed said ignition coil, said first leg being adapted to cooperate with said rotating magnetic field to cause discharge of said capacitor into said ignition coil; and said second stator further having a second leg, said second leg having at least one aperture therethrough adapted to cooperate with said existing mounting means of said engine for securing said second stator with said first leg in a second predetermined position relative to said rotating magnetic field, said second predetermined position being displaced relative to said first predetermined position in accordance with the difference of said first ignition timing of said conventional ignition system and a second ignition timing of said capacitive discharge ignition system, said second ignition timing being determined by said second predetermined position relative to the rotor and said rotating magnetic field whereby said desired ignition timing of said engine is maintained.

8. A substitute capacitive discharge ignition system as set forth in claim 7 wherein said first leg is further adapted to cooperate with said rotating magnetic field to charge said capacitor.

9. A substitute capacitive discharge ignition system as set forth in claim 8 wherein said ignition coil comprises a primary winding and a secondary winding disposed over said primary winding.

10. A substitute capacitive discharge ignition system as set forth in claim 9 wherein said capacitive discharge circuit means is adapted to discharge said capacitor into said primary ignition coil winding, said primary ignition coil winding inducing said high energy ignition pulses in said secondary winding.

11. A substitute capacitive discharge ignition system as set forth in claim 9 wherein said ignition coil further comprises an auxiliary coil which is adapted to cooperate with said rotating magnetic field to charge said capacitor.

12. A substitute capacitive discharge ignition system as set forth in claim 11 wherein said auxiliary coil is disposed on said first leg adjacent but spaced apart from said primary and said secondary ignition coils.

13. A substitute capacitive discharge ignition system as set forth in claim 7 wherein said second stator further comprises an interconnecting member extending between said first and second legs, said interconnecting member having an elongated aperture therethrough adapted to cooperate with said existing mounting means of said engine for securing said second stator with said first leg in said second predetermined position relative to said rotating magnetic field.

14. A substitute capacitive discharge ignition system as set forth in claim 7 wherein said stator structure further comprises a third leg having an elongated aperture therethrough adapted to cooperate with said existing mounting means of said engine.

15. A substitute capacitive discharge ignition system as set forth in claim 7 wherein said second leg includes a second elongated aperture spaced apart from said one elongated aperture, said second elongated aperture also being adapted to cooperate with said existing mounting means of said engine.

16. For an internal combustion engine having a rotor with magnetic field means for providing a rotating magnetic field and a conventional ignition system including a first stator with at least a first stator leg cooperative with said rotating magnetic field for providing high voltage ignition pulses for said engine, said engine further having existing mounting means thereon for securing said first stator of said conventional ignition system to said engine with said first stator leg in a first predetermined position relative to the rotor and hence to said rotating magnetic field to provide first ignition timing for said engine for providing the desired ignition timing for the engine, said first ignition timing determined by said first predetermined position, a substitute capacitive discharge ignition system comprising:

a second stator, a primary ignition coil mounted on said second stator;

a secondary ignition coil mounted on said second stator concentrically and generally coextensively with said primary ignition coil;

an auxiliary coil mounted on said second stator adjacent said primary and said secondary ignition coils;

capacitive discharge circuit means including a capacitor adapted to be discharged into said primary ignition coil thereby including a high energy ignition pulse in said secondary coil;

said auxiliary coil being adapted to cooperate with said capacitive discharge circuit means for charging said capacitor in response to said rotating magnetic field; and said second stator having at least one leg adapted to cooperate with said rotating magnetic field to cause discharge of said capacitor into said primary ignition coil and having selected mounting means adapted to cooperate with said existing mounting means of said engine for securing said second stator with said one leg in a second predetermined position relative to said rotating magnetic field, said second predetermined position being displaced relative to said first predetermined position in accordance with the difference of said first ignition timing of said conventional ignition system and a second ignition timing of said capacitive discharge ignition system, said second ignition timing being determined by said second predetermined position relative to the rotor and said rotating magnetic field whereby said desired ignition timing of said engine is substantially maintained.

17. A substitute capacitive discharge ignition system as set forth in claim 16 wherein said auxiliary coil, said primary ignition coil and said secondary ignition coil are disposed on said one leg of said second stator.

18. A substitute capacitive discharge ignition system as set forth in claim 17 wherein said auxiliary coil is spaced apart from said primary and secondary ignition coils.

19. A substitute capacitive discharge ignition system as set forth in claim 16 wherein said one leg has an end adjacent said rotating magnetic field, said primary and said secondary ignition coil being disposed on said one leg, said auxiliary coil being disposed on said one leg between said primary and secondary ignition coils and said rotating magnetic field.

20. A substitute capacitive discharge ignition system as set forth in claim 16 wherein said primary and said secondary ignition coils and said auxiliary coil are all wound counterclockwise, the finish ends of each of said primary and secondary ignition coils and said auxiliary coil being interconnected.

21. A substitute capacitive discharge ignition system as set forth in claim 16 wherein said primary ignition coil and said auxiliary coil are wound counterclockwise, said secondary ignition coil is wound clockwise and the starting ends of said primary ignition coil and said auxiliary coil are interconnected with the finish end of said secondary ignition coils.

22. For an internal combustion engine having a rotor with magnetic field means for providing a rotating magnetic field and a conventional ignition system including a first stator with at least a first stator leg cooperative with said rotating magnetic field for providing high voltage ignition pulses for said engine, said engine further having existing mounting means thereon for securing said conventional ignition system to said engine with said first stator leg in a first predetermined position relative to said rotating magnetic field, said rotating magnetic field being in a first predetermined position relative to a shaft on which said rotating magnetic field is disposed to provide first ignition timing for said engine for providing the desired ignition timing for the engine, a substitute capacitive discharge ignition system comprising:

a second stator, an ignition coil mounted on said second stator and adapted to provide high voltage ignition pulses for said engine;

capacitive discharge circuit means including a capacitor adapted to be discharged into said ignition coil for providing high energy ignition pulses;

said second stator having at least one leg adapted to cooperate with said rotating magnetic field to cause discharge of said capacitor into said ignition coil and having selected mounting means adapted to cooperate with said existing mounting means of said engine for securing said second stator structure, said one leg being adapted to vary the position of said rotating magnetic field at which said capacitor discharges into said ignition coil in response to the speed of said engine; and positioning means to position said second stator to a second predetermined position relative to said shaft and hence to said rotating magnetic field, said second predetermined position being displaced relative to said first predetermined position in accordance with the difference of said first ignition timing of said conventional ignition system and a second ignition timing of said capacitive discharge ignition system, said second ignition timing being determined by said second predetermined position relative to said shaft and hence to said rotating magnetic field whereby said desired ignition timing of said engine is substantially maintained.

23. A substitute capacitive discharge ignition system as set forth in claim 22 wherein said one leg has a first segment of a predetermined length disposed at one end, said one leg further having a second segment disposed at said one end, said second segment being spaced apart from said first segment and of a length less than said predetermined length.

24. A substitute capacitive discharge ignition system as set forth in claim 23 wherein said first segment communicates with said rotating magnetic field before said second segment.

25. A substitute capacitive discharge ignition system as set forth in claim 22 with said positioning means comprising a disc having an aperture therein, a first protrusion extending axially from said aperture circumference, a second protrusion extending axially from said aperture circumference and angularly displaced from said first protrusion, said first and said second protrusion being adapted to engage respective slots on said shaft whereby said rotating magnetic field is displaced towards said second predetermined position relative to said shaft.

* * * * *

UNITED STATES PATENT AND TRADEMARK OFFICE

CERTIFICATE OF CORRECTION

PATENT NO. : 4,829,970

DATED : May 16, 1989

INVENTOR(S) : Thomas F. Carmichael

It is certified that error appears in the above-identified patent and that said Letters Patent is hereby corrected as shown below:

Col. 5, line 9, delete "94" and substitute therefor --92--

Col. 10, line 30, delete "gab" and substitute therefor --gap--

Col. 14, line 1, Claim 16, delete "including" and substitute therefor --inducing--

Signed and Sealed this

Fifteenth Day of May, 1990

*Attest:*

HARRY F. MANBECK, JR.

*Attesting Officer*

*Commissioner of Patents and Trademarks*